US008627541B2

(12) United States Patent
Bensussan

(10) Patent No.: US 8,627,541 B2
(45) Date of Patent: Jan. 14, 2014

(54) MOP PRESS HAVING TOP AND BOTTOM CAM TRACKS

(75) Inventor: Bernard Leon Bensussan, Monroe, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 1685 days.

(21) Appl. No.: 11/253,310

(22) Filed: Oct. 19, 2005

(65) Prior Publication Data

US 2007/0084009 A1 Apr. 19, 2007

(51) Int. Cl.
*A47L 13/59* (2006.01)

(52) U.S. Cl.
USPC ..... 15/261

(58) Field of Classification Search
USPC ..... 15/260, 261; 68/241; 100/116, 125, 100/131, 132, 233
See application file for complete search history.

(56) References Cited

U.S. PATENT DOCUMENTS

| | | | | |
|---|---|---|---|---|
| 697,223 | A | 4/1902 | Towne | |
| 818,722 | A | 4/1906 | Wetmore | |
| 1,157,152 | A * | 10/1915 | Davis | 15/261 |
| 1,504,990 | A | 8/1922 | Stafford | |
| 1,767,385 | A * | 6/1930 | Logan | 15/261 |
| 1,871,903 | A * | 8/1932 | Neldner | 15/261 |
| 1,954,648 | A | 4/1934 | Reitzel | |
| 1,493,926 | A | 5/1943 | Eiffe | |
| 2,337,319 | A | 12/1943 | Elkington | |
| 2,651,073 | A | 9/1953 | Roe | |
| 4,047,261 | A | 9/1977 | Rones | |
| 4,528,717 | A | 7/1985 | Osberghaus | |
| 4,580,307 | A | 4/1986 | Moss | |
| 4,620,340 | A | 11/1986 | Bohacek | |
| 4,663,798 | A | 5/1987 | Sacks | |
| 4,707,877 | A | 11/1987 | Griffin | |
| 4,754,518 | A | 7/1988 | Griffin | |
| 4,912,804 | A | 4/1990 | Pasbol | |
| 4,974,281 | A | 12/1990 | Shaw | |
| 5,070,574 | A | 12/1991 | Delmerico | |

(Continued)

FOREIGN PATENT DOCUMENTS

| | | |
|---|---|---|
| EP | 0801925 | 9/1996 |
| EP | 0824008 | 8/1997 |
| EP | 0824008 | 2/1998 |
| LU | 90064 | 9/1997 |

OTHER PUBLICATIONS

International Search Report based on PCT/US2006/40126 dated May 15, 2007.
Written Opinion based on PCT/US2006/40126 dated May 15, 2007.

(Continued)

*Primary Examiner* — Randall Chin
(74) *Attorney, Agent, or Firm* — Ohlandt, Greeley, Ruggiero & Perle, LLP

(57) ABSTRACT

A mop press having a front wall and a pair of sidewalls is provided. The sidewalls each have a top cam track, a bottom cam track, and a bucket slot. The bucket slot defines a shoulder, where the bottom cam track is positioned below the shoulder. In some embodiments, the mop press includes a moveable press-plate and a handle mechanism. The handle mechanism includes a left and right couplings each configured to removably receive a pressing arm therein. In other embodiments, the mop press includes a locking mechanism having a locking arm rotatably supported by the sidewalls for movement between a locking position and an unlocking position. The locking position is above the unlocking position.

26 Claims, 8 Drawing Sheets

(56) References Cited

U.S. PATENT DOCUMENTS

| | | | |
|---|---|---|---|
| 5,333,352 | A | 8/1994 | McDonald |
| 5,333,353 | A | 8/1994 | Taylor |
| 5,404,611 | A | 4/1995 | Raney |
| 5,584,091 | A | 12/1996 | Borofsky |
| 5,608,942 | A | 3/1997 | Disbrow |
| 5,615,446 | A | 4/1997 | Cetnarowski |
| 5,720,073 | A | 2/1998 | Kamada |
| 5,974,621 | A | 11/1999 | Wilen |
| 5,983,441 | A | 11/1999 | Williams |
| 6,006,397 | A | 12/1999 | Williams |
| 6,115,877 | A | 9/2000 | Morad |
| 6,128,803 | A | 10/2000 | Dickinson |
| 6,260,230 | B1 | 7/2001 | Hunt |
| 6,279,195 | B1 | 8/2001 | Biggs |
| 6,327,740 | B1 | 12/2001 | Baltazar |
| 6,389,638 | B1 | 5/2002 | Dickinson |
| 6,457,203 | B1 | 10/2002 | Williams |
| 6,523,220 | B1 | 2/2003 | Lynn |
| 6,671,923 | B2 | 1/2004 | Gromnicki |
| 6,684,450 | B2 | 2/2004 | Dingert |
| 6,823,557 | B2 | 11/2004 | Dingert |
| 6,941,612 | B1 | 9/2005 | Hirse |
| 6,944,907 | B2 | 9/2005 | Lynn |

OTHER PUBLICATIONS

European Search Report dated Jul. 28, 2009 for corresponding European Application, No. EP 06 81 6884.
Communication Pursuant to Rule 114(2) EPC from Europen Patent Application No. 06816884.8-2316 dated Mar. 10, 2009.
First and Second Office Actions from U.S. Appl. No. 11/253,310, (2008, 2009).
Price List dated May 1995 of firm TTS Tecno Trolley System (p. 1, 15 & 20).
Price List dated Jan. 2002 of firm FILMOP (p. 1, 42 & 43).
Depliant "Orion & Vega" dated May 2001 of firm FILMOP.
Depliant "The PUNTO" dated Apr. 2002 of firm FILMOP.
Depliant "ARKA" dated Feb. 2002 of firm FILMOP.
Brochure "MaxiJolly" undated of firm FILMOP with enlargement.
European Office Action dated Apr. 30, 2013 from corresponding European application No. 06816884.8, 5 pages.

* cited by examiner

MOP PRESS HAVING TOP AND BOTTOM CAM TRACKS

BACKGROUND OF THE INVENTION

1. Field of the Invention

The present disclosure is related to mops and mopping tools. More particularly, the present disclosure is related to a mop press for pressing excess liquid from a mop head.

2. Description of Related Art

Mops are typically used to clean floors or other surfaces by dipping the mop head into a cleaning or rinsing liquid and pressing or wringing excess liquid from the mop head. The damp mop head is then moved across the surface to be cleaned. This process of wetting the mop head, wringing excess liquid from the mop head, and moving the damp mop head across the surface to be cleaned is repeated until complete.

Mop presses for wringing excess liquid from mop heads are known. For example, EP0824008 provides a mop press. Such mop presses typically include a press-plate that is moveable against a stationary wall. In this manner, the excess liquid can be pressed from the mop head by compressing the head between the press-plate and the wall.

Such mop presses are typically attached to a bucket or container so that the excess liquid, which is removed from the mop head, is captured in the bucket. Unfortunately, many prior mop presses allow liquid pressed from the mop head to spill outside of the bucket and, thus, back onto the surface being cleaned.

Many prior mop presses are removably attached to the bucket for ease of use of the bucket. After pressing, the mop head is removed from between the press-plate and the wall. Unfortunately, this action can cause the mop head to catch on the press-plate and/or wall so that the mop press inadvertently becomes unattached from the bucket. Some mop presses have attempted to resolve this problem by providing a locking mechanism for releasably securing the mop press to the bucket. However, such prior art locking mechanisms have been difficult to unlock, which reduces the efficiency of the user of the mop press.

Accordingly, there is a continuing desire for mop presses that overcome and/or mitigate the above and other deleterious effects of prior art mop presses.

BRIEF SUMMARY OF THE INVENTION

A mop press having a front wall and a pair of sidewalls is provided. The sidewalls each have a top cam track, a bottom cam track, and a bucket slot. The bucket slot defines a shoulder, where the bottom cam track is positioned below the shoulder.

A mop press having a front wall, a pair of sidewalls, a moveable press-plate, and a handle mechanism is also provided. The handle mechanism moves the moveable press-plate between an open position and a compressing position. The handle mechanism includes a shaft rotatably supported by the pair of side walls, a left coupling extending from the shaft, a right coupling extending from the shaft, and a pressing arm. The left and right couplings are each configured to removably receive the pressing arm therein.

A mop press having a front wall, a pair of sidewalls, a moveable press-plate, and a locking mechanism is provided. The locking mechanism includes a locking arm rotatably supported by the sidewalls and at least one locking tab on the locking arm. The locking arm has a locking position and an unlocking position, where the locking position is above the unlocking position.

The above-described and other features and advantages of the present invention will be appreciated and understood by those skilled in the art from the following detailed description, drawings, and appended claims.

DETAILED DESCRIPTION OF THE INVENTION

Figure 1:
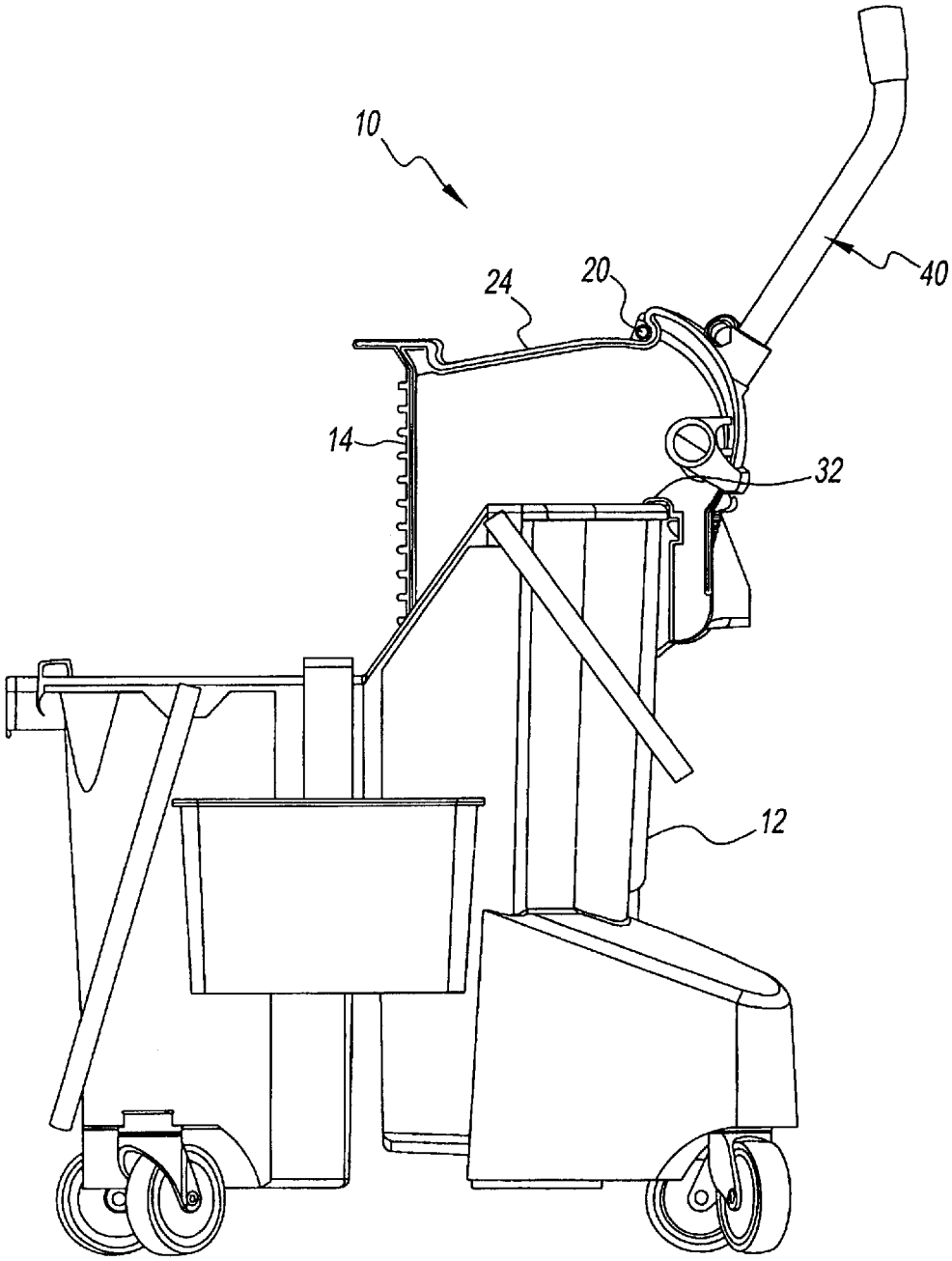
FIG. 1 is a side view of an exemplary embodiment of a mop press according to the present disclosure in use with a typical bucket.

Referring to the drawings and in particular to FIGS. 1 through 6, a mop press according to the present disclosure is generally referred to by reference numeral 10. Mop press 10 finds use with a bucket 12 as shown in FIG. 1.

Advantageously, mop press 10 ensures that substantially all of the liquid that is pressed from a mop head (not show) is captured in bucket 12. Specifically, mop press 10 is configured to prevent or mitigate pressed liquid from squirting out of the press above the bucket 12. In addition, mop press 10 can easily be converted for use by left handed or right handed users. Further, mop press 10 includes an easy to use locking mechanism that maintains the mop press attached to the bucket when desired and yet can be removed from the bucket when desired with a single upward movement.

Mop press 10 includes a front wall 14, a moveable press-plate 16, and a pair of sidewalls 18. Press-plate 16 includes a set of top cam followers 20 and a set of bottom cam followers 22. Similarly, each sidewall 18 includes a top cam track 24 and a bottom cam track 26. Each top cam follower 20 follows a respective top cam track 24, while each bottom cam follower 22 follows a respective bottom cam track 26.

In this manner, the movement of press-plate 16 between an open position (FIGS. 1-4) and a compressing position (FIG. 5) is defined by the shape of cam tracks 24, 26 and/or the position of cam followers 20, 22. In the open position, mop press 10 is configured to receive a mop head between front wall 14 and moveable press-plate 16. In one embodiment, press-plate 16 is in a generally vertical state in the open position so that the top and bottom of the press-plate are generally equidistant from front wall 14. In other embodiments, press-plate 16 is in a generally angled state in the open position so that the top of the press-plate is farther from front wall 14 than the bottom of the press-plate.

In the compressing position, mop press 10 is configured to compress the mop head between front wall 14 and press-plate 16 to press excess liquid from the mop head. Specifically, press-plate 16 is substantially closer to front wall 14 when in compressing position than when in the open position.

In some embodiments, press-plate 16 can include a plurality of openings 28 to allow pressed liquid to flow through the press-plate. Preferably, front wall 14 is a rigid wall, namely lacking openings to prevent pressed liquid from flowing through the front wall.

Figure 4:
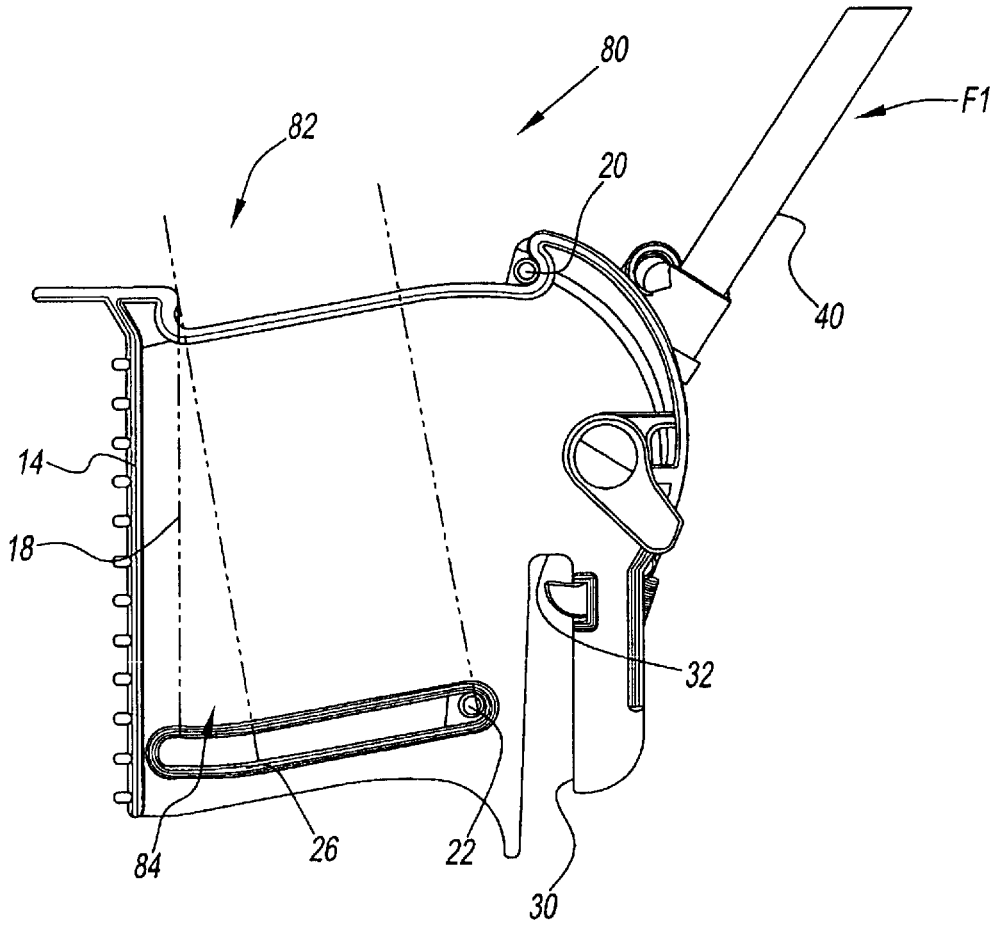
FIG. 4 is a side view of the mop press of FIG. 1, shown in a locking position.

Mop press 10 includes a slot 30 defined in each of the sidewalls 18 as shown in FIG. 4. Slots 30 are received over a wall of bucket 12 as shown in FIG. 1 so that a shoulder 32 at the top of the slots rests on the wall of the bucket. In this position, mop press 10 is supported on bucket 12 so that a bottom opening of the mop press is within the bucket.

Advantageously, bottom cam tracks 26 are defined in walls 18 below shoulder 32. Thus, when mop press 10 is mounted on bucket 12, bottom cam tracks 26 are below the wall of the bucket. In this position, liquid pressed out of a mop head through bottom cam tracks 26 by the compressive action of front wall 14 and press-plate 16 is captured in bucket 12.

In addition, top cam followers 20 are positioned at an upper most extent of press-plate 16, while top cam tracks 24 are defined at an upper most extent of sidewalls 18. In this manner, substantially all of press-plate 16 is below top cam tracks 24. Thus, instances of liquid pressed upward over top cam tracks 24 and out of bucket 12 are mitigated.

Accordingly, mop press 10 includes press-plate 16 supported at the upper and lower most portions of side walls 18. Here, the upper most portions of side walls 18 are above substantially all of press-plate 16 and the lower most portions of the side walls are well below the side walls of bucket 12, which combine to ensure that liquid pressed out of a mop head is captured in the bucket.

In some embodiments, front wall 14 can include a plurality of structural ribs 34 (FIG. 3) for supporting the front wall against the forces imparted by the compression of the mop head against the front wall by press-plate 16. Front wall 14 can also include a handle 36, generally located at the top edge of the wall, to assist a user to install and/or remove mop press 10 from bucket 12. In some embodiments, handle 36 can include an indentation 38 sized and positioned to support a handle of a mop that is stored in bucket 12.

Figure 2:
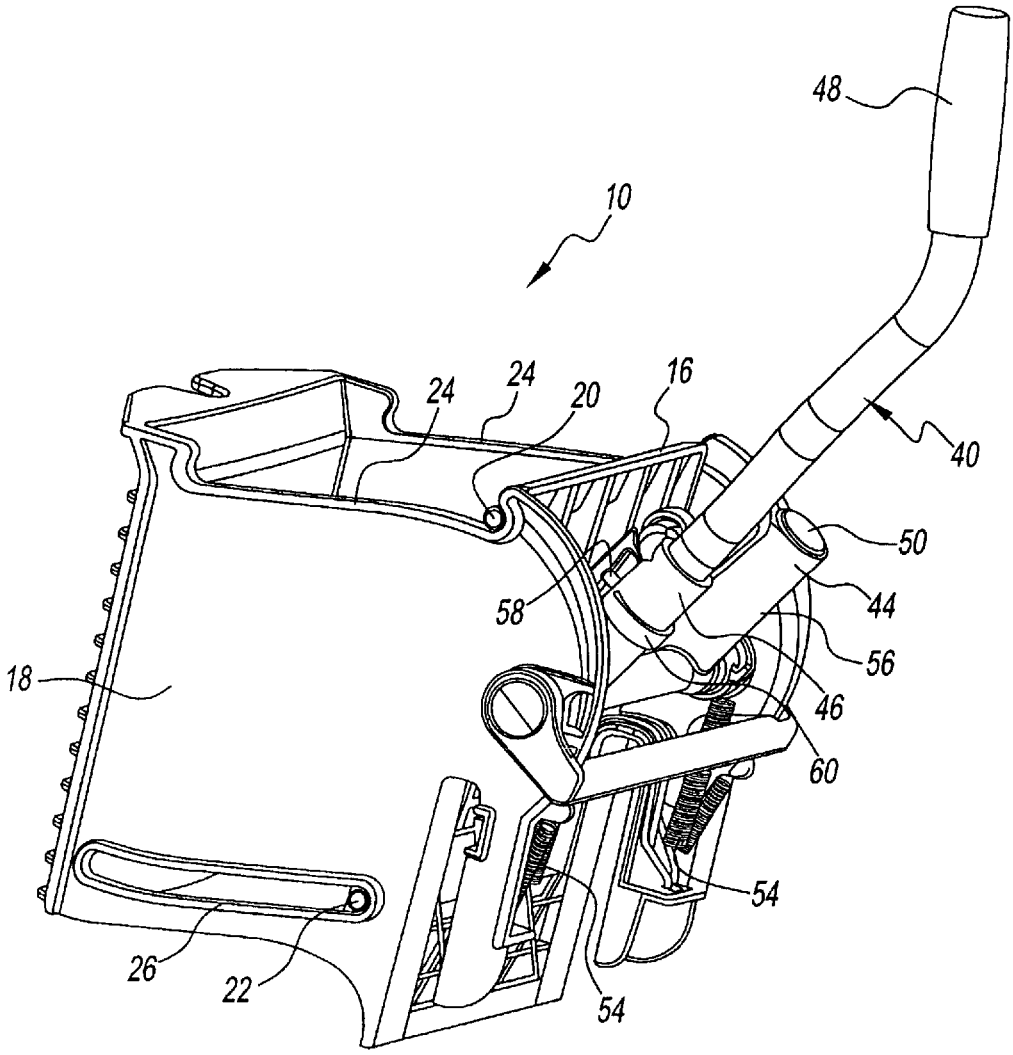
FIG. 2 is a rear top perspective view of the mop press of FIG. 1.
Figure 3:
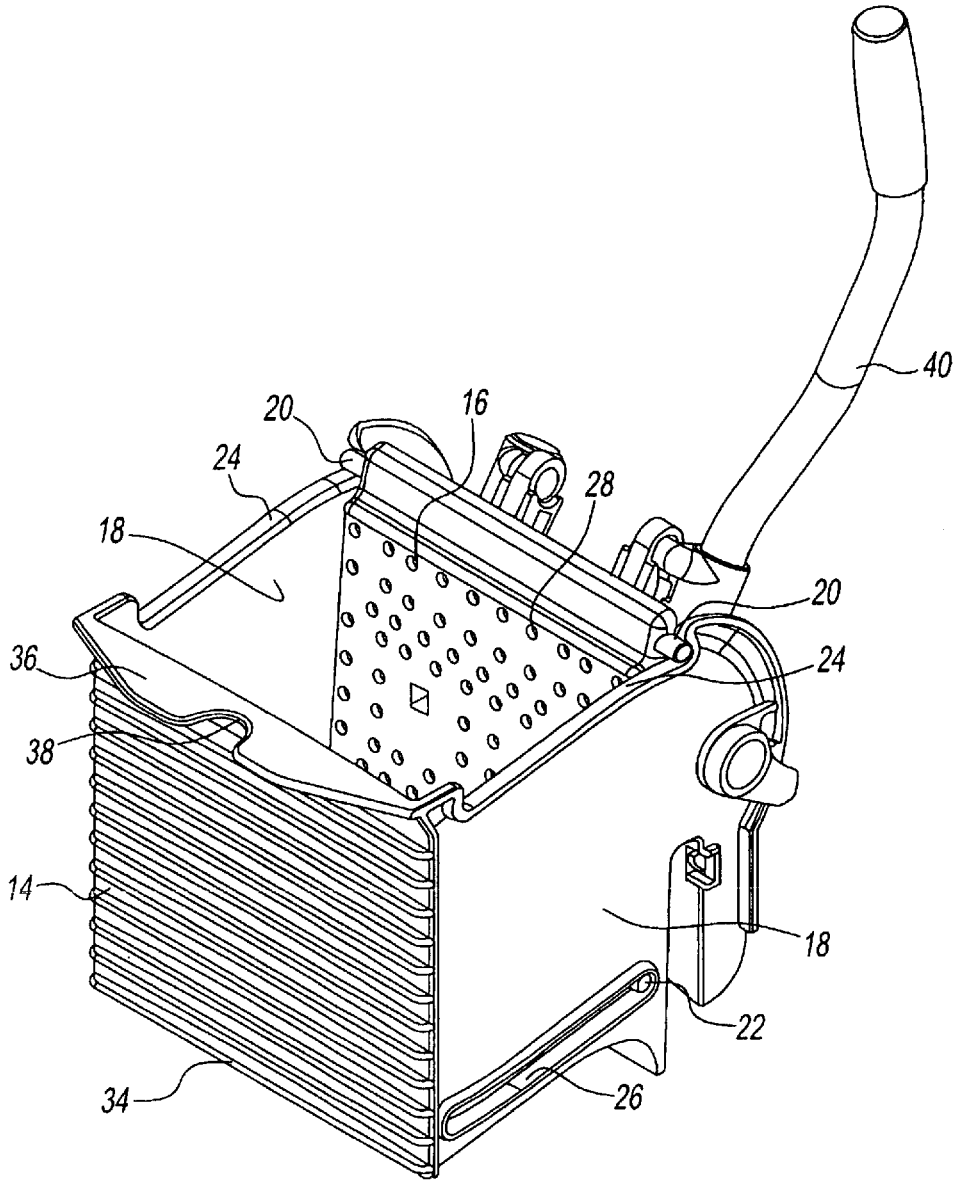
FIG. 3 is a front top perspective view of the mop press of FIG. 1.
Figure 5:
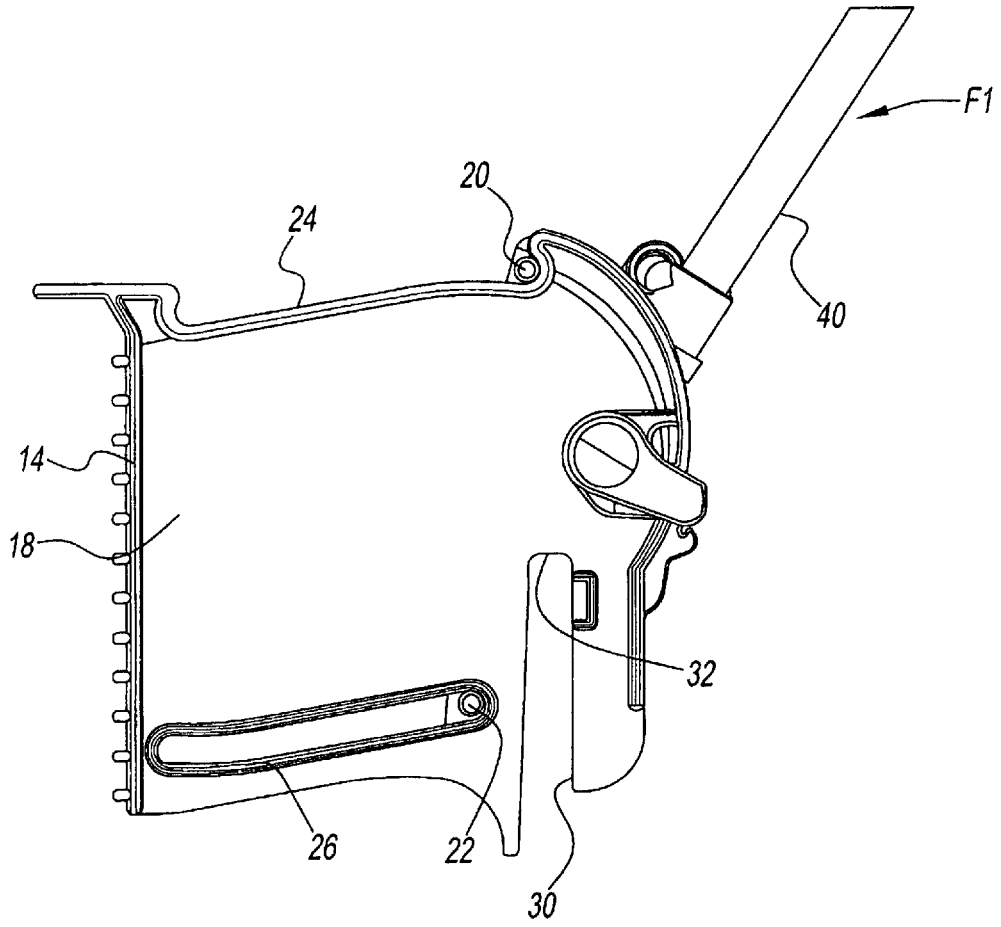
FIG. 5 is a side view of the mop press of FIG. 1, shown in an unlocking position.
Figure 6:
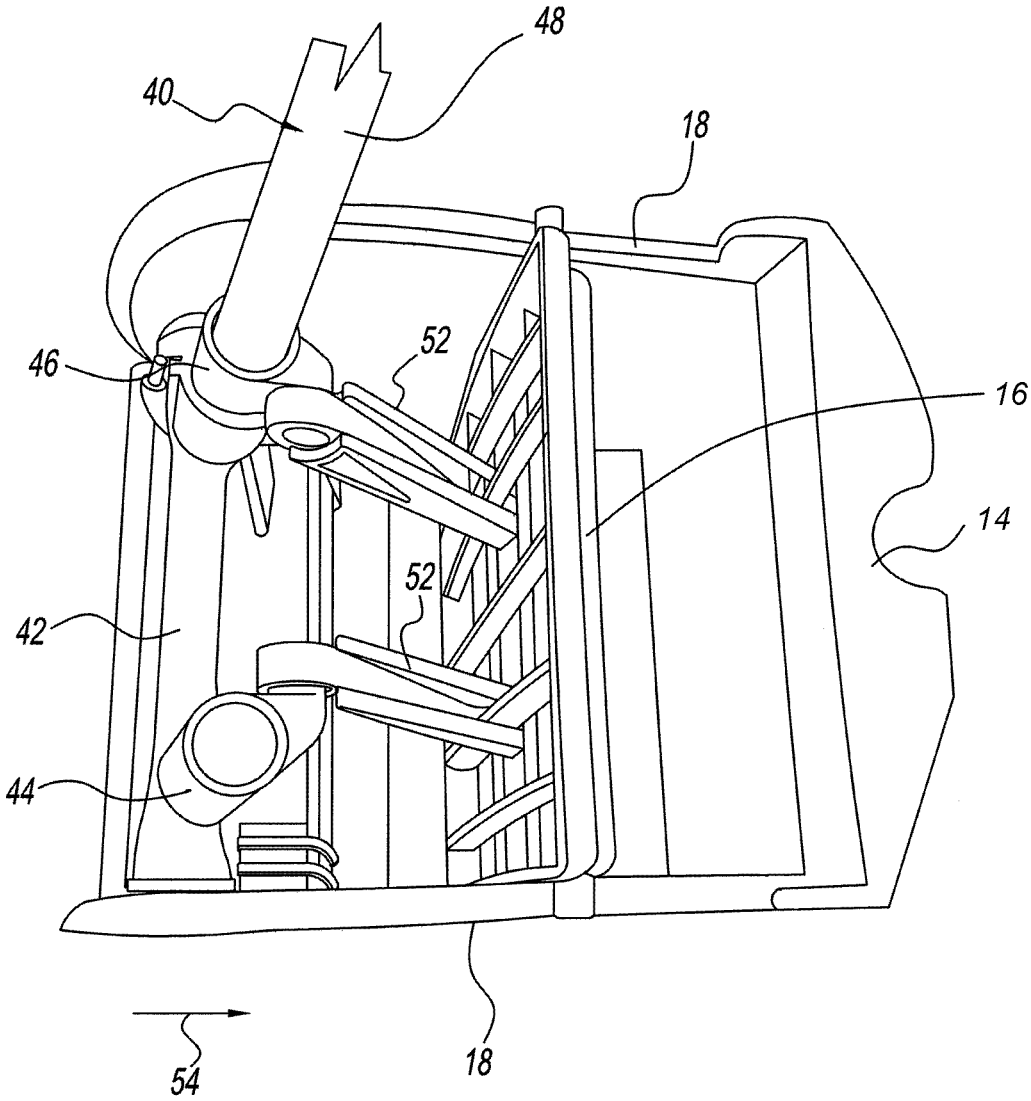
FIG. 6 is a top view of the mop press of FIG. 1, shown in a compressing position.
Figure 7:
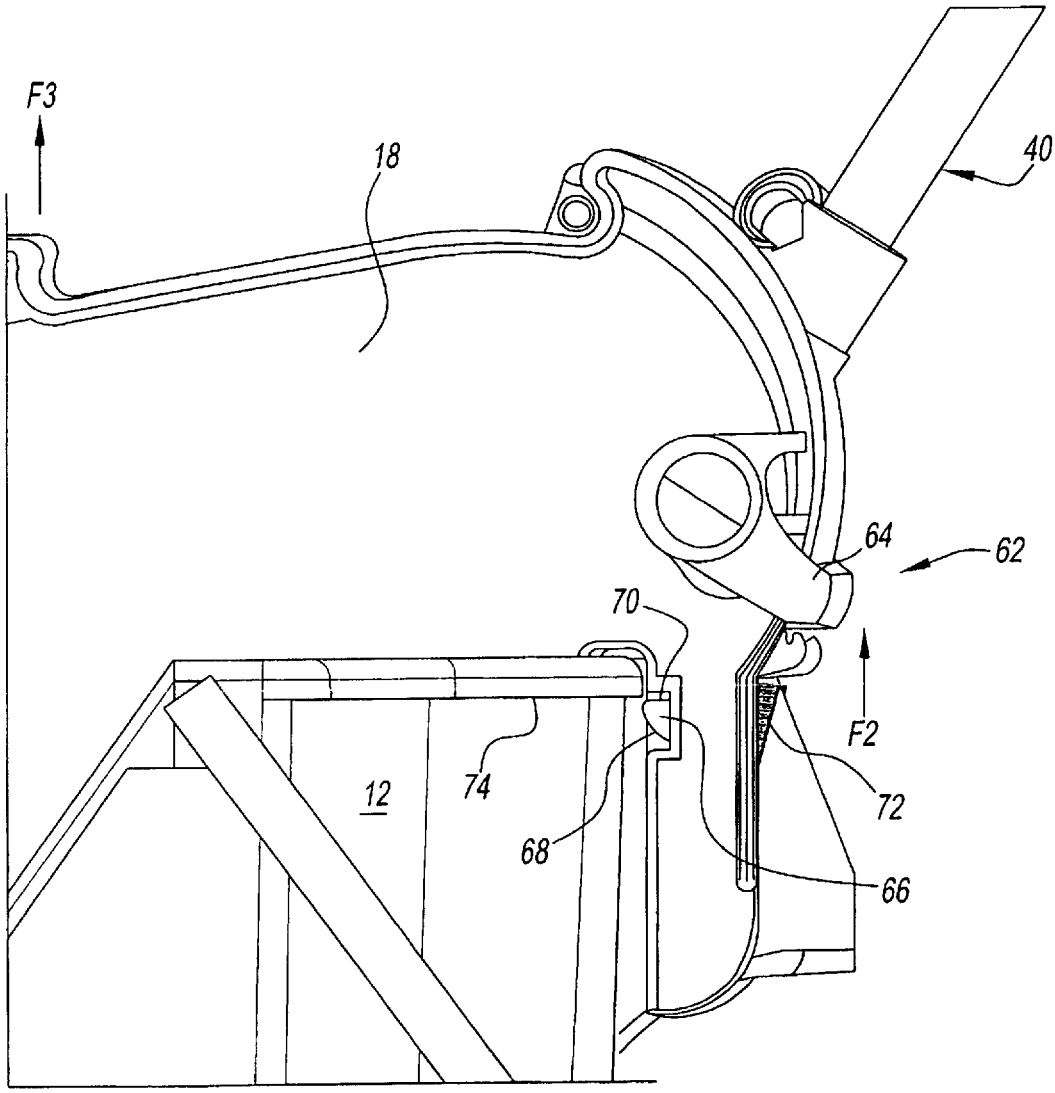
FIG. 7 is a side view illustrating an exemplary embodiment of a locking mechanism of the mop press of FIG. 1.
Figure 8:
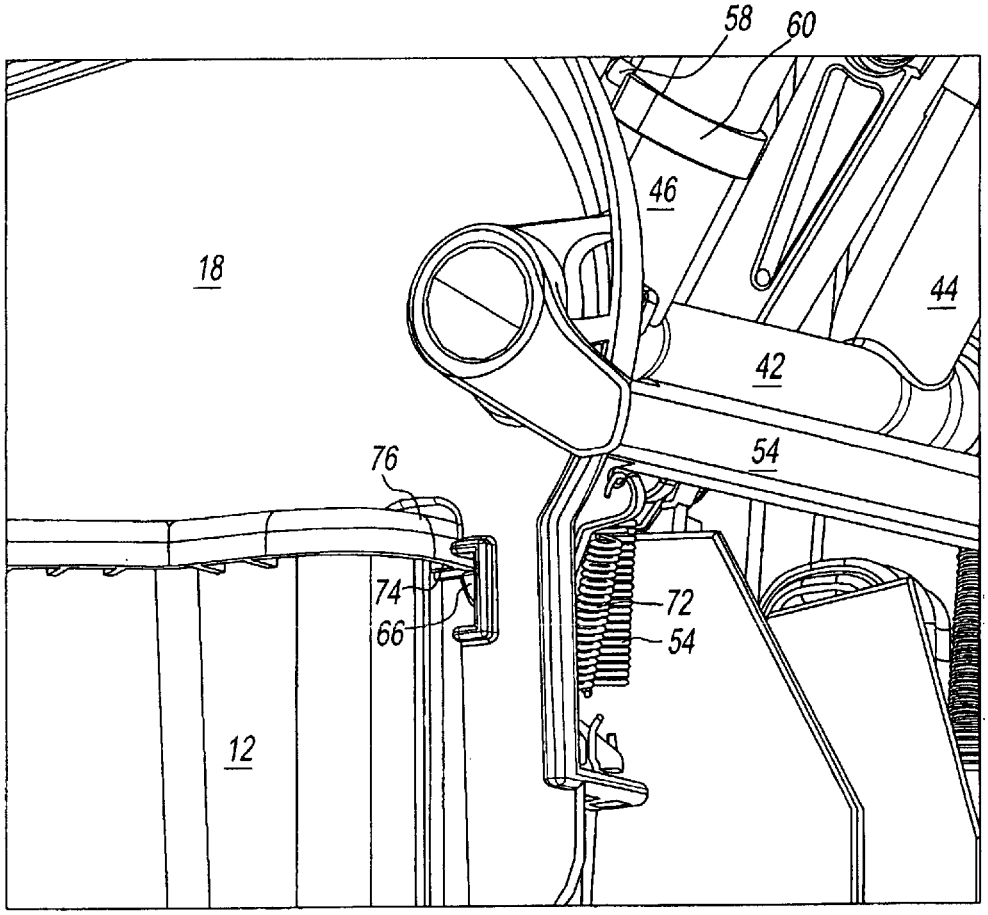
FIG. 8 is a bottom rear perspective view of the locking mechanism of FIG. 5.

Mop press 10 can easily be converted for use by left handed or right handed users. Specifically, mop press 10 includes a handle mechanism 40 for moving press-plate 16 between the open and compressing positions. As seen in FIGS. 2 and 5, handle mechanism 40 includes a shaft 42 rotatably supported by sidewalls 18. Shaft 42 includes a left coupling 44 and a right coupling 46 extending therefrom.

Couplings coupling 44, 46 are each configured to removably receive a pressing arm 48 therein. Thus, pressing arm 48 can be selectively positioned by the user in left coupling 44 or right coupling 46 as desired. In some embodiments, handle mechanism 40 can include a cap 50. Cap 50 can also be selectively positioned by the user in left coupling 44 or right coupling 46 as desired. Thus, the user can place arm 48 in one of the couplings 44, 46 and cap 50 in the other coupling.

Couplings 44, 46 are secured to press-plate 16 by a pair of legs 52. Movement of pressing arm 48 in a compressing direction 54 is imparted to shaft 42 and legs 52 via couplings 44, 46 to move press-plate 16 from open position to the compressing position. Since couplings 44, 46 are positioned at the left and right sides of shaft 42, respectively, legs 52 ensure that the force imparted to pressing arm 48 is imparted equally to opposite sides of press-plate 16.

In some embodiments, mop press 10 includes one or more return springs 54. Return springs 54 are connected between shaft 42 and sidewalls 18. Springs 54 are in a normal or un-stressed state when press-plate 16 is in the open position. Conversely, springs 54 are in an extended or stressed state when press-plate 16 is in the compressing position. In this manner, return springs 54 maintain press-plate 16 in the open position unless a force F1 is applied to pressing arm 48. Further, return springs 54 return press-plate 16 to the open position upon release of the force F1 from pressing arm 48.

In some embodiments, pressing arm 48 and/or cap 50 can be releasably secured in couplings 44, 46. For example, couplings 44, 46, arm 48, and cap 50 can each include an opening 56 defined therethough. When arm 48 and cap 50 are positioned in couplings 44, 46, opening 56 is aligned to receive a locking pin 58 therethrough. Preferably, locking pin 58 is secured to couplings 44, 46 by a resilient semi-circular locking ring 60. For purposes of clarity, pressing arm 48 is illustrated releasably secured in coupling 44 via pin 58 and ring 60, while cap 50 is illustrated secured in coupling 46 in a press fit manner.

It is also contemplated by the present disclosure for mop press 10 to include an easy to use locking mechanism 62 as shown in FIGS. 4 through 8. Advantageously, locking mechanism 62 maintains mop press 10 attached to bucket 12 when desired and yet allows the mop press to be removed from the bucket when desired with a single upward movement.

Locking mechanism 62 includes a locking arm 64 rotatably supported by sidewalls 18. Locking arm 64 has a pair of locking tabs 66 thereon. Locking tabs 66 have a cam surface 68 and a locking surface 70.

Locking arm 64 moves between a locking position (FIG. 4) and an unlocking position (FIG. 5). The unlocking position is lower than the locking position so that locking arm 64 is lifted to move the arm to the unlocking position. In the locking position, locking arm 64 moves locking tab 66 so that locking surface 70 prevents mop press 10 from being removed from bucket 12. Specifically, locking surface 70 interferes with a portion of bucket 12, such as a lip 74, during removal when locking arm 64 is in the locking position. However, locking surface 70 is clear from interference with bucket 12 during removal when locking arm 64 is in the unlocking position.

Locking mechanism 62 can also include one or more locking springs 72 to normally bias locking arm 64 to the locking position. Locking springs 72 are connected between locking arm 64 and sidewalls 18. Springs 72 are in a normal or un-stressed state when locking arm 64 is in the locking position. Conversely, springs 72 are in an extended or stressed state when locking arm 64 is in the unlocking position. In this manner, locking springs 72 maintain locking arm 64 in the locking position unless an upward force F2 is applied to the locking arm. Further, locking springs 72 return locking arm 64 to the locking position upon release of the force F2 from the locking arm.

Advantageously, the upward force F2 necessary to move locking arm 64 from locking position to unlocking position is in the same direction as the upward force F3 necessary to remove mop press 10 from bucket 12. During removal of mop press 10 from bucket 12, a user can grasp handle 36 at the front of the mop press and locking arm 64 are the rear of the mop press. The upward lifting force F3 necessary to remove mop press 10 from bucket 12 is thus imparted to locking arm 64 and is sufficient to move the locking arm to the unlocking position. In this manner, locking mechanism 62 maintains mop press 10 attached to bucket 12 when desired and yet allows the mop press to be removed from the bucket when desired with a single upward movement.

Cam surface 68 is configured to move locking arm 64 from the locking position to the unlocking position during installation of mop press 10 on bucket 12. Specifically, cam surface 68 is configured to act on a portion of bucket 12, such as a rim 76, as mop press 10 is install on bucket 12. As cam surface 68 rides over rim 76, the cam surface imparts a force to locking tabs 66 sufficient to overcome the force of locking spring 72 and, thus, to move locking arm 64 to the unlocking position.

The movement of press-plate 16 between the open position and the compressing position is described with reference to FIGS. 4 and 5. The movement of press-plate 16 is defined by the shape of cam tracks 24, 26 and/or the position of cam followers 20, 22. For example, in the illustrated embodiment, cam tracks 24, 26 and cam followers 20, 22 cooperate with one another to define a first zone of movement 80, a second zone of movement 82, and a third zone of movement 84.

In the first zone of movement 80, top cam followers 20 move along top cam track 24, but bottom cam followers 22 stay substantially stationary in bottom cam track 26. Thus, first zone of movement 80 moves press-plate 16 so that the top of the press-plate is substantially closer to front wall 14 then the bottom of the press-plate to begin removing water from the top of the mop head positioned between the press-plate and the front wall.

In the second zone of movement 82, top cam followers 20 move along top cam track 24 and bottom cam followers 22 move bottom cam track 26 at a substantially similar rate. Thus, second zone of movement 82 moves press-plate 16 so that the top of the press-plate remains closer to front wall 14 then the bottom of the press-plate to evenly remove water from the top to the bottom of the mop head.

In the third zone of movement 84, bottom cam followers 22 move along bottom cam track 26, but top cam followers 20 stay substantially stationary in top cam track 24. Thus, third zone of movement 84 moves press-plate 16 so that the bottom of the press-plate is substantially as close to front wall 14 as the top of the press-plate to remove water from the bottom of the mop head.

In this manner, mop press 10 is configured to first remove water from the top of a mop head during first zone of movement 80, then evenly remove water from the top of the mop head toward the bottom of the mop head during second zone of movement 82, and finally to remove any remaining water from the bottom of the mop head during third zone of movement 84.

It should also be noted that the terms "first", "second", "third", "upper", "lower", "front", "rear", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A mop press comprising:
a front wall; and
a pair of side walls each having a top cam track, a bottom cam track, and a bucket slot, said bucket slot defining a shoulder, wherein said bottom cam track is positioned entirely below said shoulder and wherein said top cam tracks are defined by an upper most edge of said pair of side walls; and further comprising a moveable press-plate having a set of top cam followers and a set of bottom cam followers, each of said top cam tracks receiving a respective one of said set of top cam followers and each of said bottom cam tracks receiving a respective one of said set of bottom cam followers.

2. The mop press of claim 1, wherein said set of top cam followers are positioned at an upper most extent of said moveable press-plate.

3. The mop press of claim 1, wherein substantially all of said moveable press-plate is below said top cam tracks of each of said pair of side walls.

4. The mop press of claim 1, further comprising a handle mechanism for moving said moveable press-plate between an open position and a compressing position, said handle mechanism having a pressing arm positionable in either a left side or a right side of said handle mechanism.

5. The mop press of claim 1, wherein said front wall is a rigid wall that prevents pressed liquid from flowing through said front wall.

6. The mop press of claim 1, wherein said front wall comprises a plurality of structural ribs.

7. The mop press of claim 1, wherein said front wall comprises a handle.

8. The mop press of claim 7, wherein said handle comprises an indentation, said indentation being sized and positioned to support a mop handle.

9. A mop press comprising:
a front wall;
a pair of side walls;
a moveable press-plate; and
a handle mechanism for moving said moveable press-plate between an open position and a compressing position, said handle mechanism having a shaft rotatably supported by said pair of side walls, a left coupling extending from said shaft, a right coupling extending from said shaft, and a pressing arm, wherein said left and right couplings are each configured to removably receive said pressing arm therein.

10. The mop press of claim 9, wherein said pair of side walls each have a top cam track, a bottom cam track, and a mop press supporting shoulder, said bottom cam track being positioned below said mop press supporting shoulder.

11. The mop press of claim 10, wherein substantially all of said moveable press-plate is below said top cam tracks of each of said pair of side walls.

12. The mop press of claim 10, wherein said moveable press-plate comprises a set of top cam followers and a set of bottom cam followers, each of said top cam tracks receiving a respective one of said set of top cam followers and each of said bottom cam tracks receiving a respective one of said set of bottom cam followers.

13. The mop press of claim 12, wherein said set of top cam followers are positioned at an upper most extent of said moveable press-plate and said top cam tracks are defined at an upper most extent of said pair of side walls.

14. A mop press comprising:
a front wall;
a pair of side walls;
a moveable press-plate; and
a locking mechanism having a locking arm rotatably supported by said side walls and at least one locking tab on said locking arm, said locking arm being moveable between a locking position and an unlocking position, wherein said locking arm is moved from said locking position upon application of a force (F2) in the same direction as a force (F3) for removing the mop press from a bucket; and further comprising at least one locking spring normally biasing said locking arm to said locking position.

15. The mop press of claim 14, wherein said at least one locking spring is connected between said locking arm and one of said pair of side walls.

16. The mop press of claim 14, further comprising a handle mechanism for moving said moveable press-plate between an open position and a compressing position, said handle mechanism having a shaft rotatably supported by said pair of side walls, a left coupling extending from said shaft, a right coupling extending from said shaft, and a pressing arm, wherein said left and right couplings are each configured to removably receive said pressing arm therein.

17. The mop press of claim 14, wherein said pair of side walls each have a top cam track, a bottom cam track, and a mop press supporting shoulder, said bottom cam track being positioned below said mop press supporting shoulder.

18. The mop press of claim 17, wherein substantially all of said moveable press-plate is below said top cam tracks of each of said pair of side walls.

19. A mop press comprising:

a front wall;

a pair of side walls each having a top cam track and a bottom cam track; and a moveable press-plate having a set of top cam followers and a set of bottom cam followers, each of said top cam tracks receiving a respective one of said set of top cam followers and each of said bottom cam tracks receiving a respective one of said set of bottom cam followers, wherein said top and bottom cam tracks and said set of top and bottom cam followers cooperate with one another to define a movement of said moveable press-plate, said movement comprising a first zone of movement, a second zone of movement, and a third zone of movement, said first zone of movement moves said press-plate so that a top of said press-plate is substantially closer to said front wall then a bottom of the press-plate and said third zone of movement moves said press-plate so that said bottom of the press-plate is substantially as close to said front wall as said top.

20. The mop press of claim 19, wherein said second zone of movement moves said press-plate so that said top remains closer to said front wall then said bottom.

21. The mop press of claim 19, wherein said pair of side walls each comprise a bucket slot defining a shoulder, wherein said bottom cam track is positioned below said shoulder.

22. The mop press of claim 19, further comprising a handle mechanism for moving said moveable press-plate between an open position and a compressing position, said handle mechanism having a shaft rotatably supported by said pair of side walls, a left coupling extending from said shaft, a right coupling extending from said shaft, and a pressing arm, wherein said left and right couplings are each configured to removably receive said pressing arm therein.

23. The mop press of claim 19, further comprising a locking mechanism having a locking arm rotatably supported by said side walls and at least one locking tab on from said locking arm, said locking arm being moveable between a locking position and an unlocking position, wherein said locking position is above said unlocking position.

24. A mop press comprising:

a front wall; and a pair of side walls each having a top cam track and a bottom cam track, said top cam tracks being defined by an upper most edge of said pair of side walls;

a moveable press-plate having a set of top cam followers and a set of bottom cam followers, each of said top cam tracks being operatively associated with a respective one of said set of top cam followers and each of said bottom cam tracks being operatively associated with a respective one of said set of bottom cam followers.

25. The mop press of claim 24, wherein said pair of side walls each further comprise a bucket slot defining a shoulder, wherein each of said bottom cam tracks is positioned entirely below said shoulder and each of said top cam tracks is defined entirely above said shoulder.

26. The mop press of claim 24, wherein said set of top cam tracks are positioned at an upper most extent of said moveable press-plate and said set of top cam tracks are positioned so that substantially all of said moveable press-plate is below said top cam tracks.

* * * * *